US006682266B2

(12) United States Patent
Karal et al.

(10) Patent No.: US 6,682,266 B2
(45) Date of Patent: Jan. 27, 2004

(54) TENSION LEG AND METHOD FOR TRANSPORT, INSTALLATION AND REMOVAL OF TENSION LEGS PIPELINES AND SLENDER BODIES

(75) Inventors: Karel Karal, Oslo (NO); Jørgen Høgmoe, Oslo (NO); Sigurd Ramslie, Oslo (NO); Johan Lassen-Urdahl, Asker (NO)

(73) Assignee: ABB Anchor Contracting AS, Billingstad (NO)

( * ) Notice: Subject to any disclaimer, the term of this patent is extended or adjusted under 35 U.S.C. 154(b) by 47 days.

(21) Appl. No.: 10/029,965

(22) Filed: Dec. 31, 2001

(65) Prior Publication Data

US 2003/0123936 A1 Jul. 3, 2003

(51) Int. Cl.[7] ..... E21B 17/01; E02D 5/74

(52) U.S. Cl. ..... 405/223.1; 405/171; 405/224; 166/350; 166/367; 114/264; 114/267

(58) Field of Search ..... 405/171, 168.1, 405/223.1, 224, 224.1–224.4; 114/264, 265, 266, 267; 166/350, 352, 353, 354, 359, 367; 175/5, 7, 8

(56) References Cited

U.S. PATENT DOCUMENTS 4,226,555 A * 10/1980 Bourne et al. ..... 405/224
4,281,614 A * 8/1981 McNary et al. ..... 114/264
4,297,965 A * 11/1981 Horton et al. ..... 114/265
4,377,354 A * 3/1983 Morton ..... 405/171
4,630,970 A * 12/1986 Gunderson et al. ..... 405/223.1
4,634,314 A * 1/1987 Pierce ..... 405/224.2
4,636,114 A * 1/1987 Hale ..... 405/224
4,768,455 A * 9/1988 Maxson et al. ..... 114/264
4,798,500 A * 1/1989 Morton ..... 405/158
4,810,133 A * 3/1989 Kopp et al. ..... 405/168.1
4,844,659 A * 7/1989 Hunter et al. ..... 405/224
4,848,970 A * 7/1989 Hunter et al. ..... 405/224
4,938,632 A * 7/1990 Eie ..... 405/223.1
5,054,963 A * 10/1991 Williamsson ..... 405/224
5,297,632 A * 3/1994 Blandford ..... 166/344
5,683,204 A * 11/1997 Lawther ..... 405/171
6,406,222 B1 * 6/2002 Pollack ..... 405/224

FOREIGN PATENT DOCUMENTS

GB 2182375 * 5/1987 ..... 405/195.1

* cited by examiner

*Primary Examiner*—Jong-Suk Lee
(74) *Attorney, Agent, or Firm*—Browdy and Neimark

(57) ABSTRACT

A tendon which is divided into compartments enclosing therein pressurized gas. A method for transporting a fluid containing tubular body or assembly of bodies above a sea/river bed floor and within a body of water. In addition to the method for transporting the tendon a method of installing and removing an internal pressurized tendon or assembly of tendons in a vertical position in a body of water.

11 Claims, 8 Drawing Sheets

TENSION LEG AND METHOD FOR TRANSPORT, INSTALLATION AND REMOVAL OF TENSION LEGS PIPELINES AND SLENDER BODIES

1. FIELD OF THE INVENTION

The present invention relates to the design of tension legs, i.e. tendons for Tension Leg Platforms (TLP) and method for transport and installation and removal/replacement of tendons and similar slender bodies in a body of water.

2. DESCRIPTION OF THE PRIOR ART

There are two main types of tendons:

Rods made of composite or fiber materials, and hollow circular pipes welded into sections where the design seeks to utilize the buoyancy as much as possible to reduce submerged weight of the tendon in order to lessen the size of the platform that carries the weight of the tendons.

A major feature of the latter concept is that air at atmospheric pressure is present in the interior of the pipes in a tendon. Hence, when installed the tubular pipes/tendon are exposed to outer hydrostatic pressure that is an disadvantageous buckling-type loading calling for increasing the wall thickness to diameter ratio, i.e. increasing wall thickness and decreasing diameter. With increasing water depth the ratio increases and consequently the submerged weight of the tendon increases. The final consequence is that the platform's displacement must be increased that again causes larger loads on the tendons etc. This is even more pronounced for deep-water TLP tendons.

In detail two concepts of these tendons are known:

Stepped diameter tendon seeking to employ as large diameter as possible to resist the increasing hydrostatic pressure thus to achieve as much buoyancy as possible. In deeper waters it is not feasible to achieve a desirable or optimum design, namely neutrally or positively buoyant tendon. Further, this solution requires transition sections when the diameter is changed. Such transitions attract stresses causing material fatigue.

Uniform diameter tendon eliminating the fatigue stresses on the penalty of small diameter thus large loads on the platform with the associated negative consequences. The maximum achievable diameter is limited to that needed at the lower end of the tendon.

Two main transport and installation concepts are used for tendons made of hollow cylinders:

Prefabricated sections of a tendon equipped with expensive and fatigue prone connectors, are transported on deck of a vessel to installation site where these sections are handed over to a crane vessel. The crane vessel upends and connects the sections into a vertically hanging string and adds sections until the entire tendon has been completed. This is an expensive solution due to expensive vessel and connectors.

Tendon prefabricated in full length at a shore-based facility is launched into water while temporary buoyancy elements are being attached to the tendon in order to keep the tendon floating. Thereafter the tendon is towed in surface to the installation site where, by applying different more or less cumbersome methods, the tendon is upended by reduction or removal of the temporary buoyancy. Two major drawbacks are associated with such methods: (a) When towed in waves, the tendon is exposed to fatigue stresses; and (b) Large risk is associated with the use of external temporary elements, as experienced in practice. Another disadvantage is associated with these methods that is non-reversibility of some of operations. Upon negative experience from practical applications the industry is hesitant for further use of these methods.

Other slender bodies such as bottom pipelines and flowline bundles have been towed to offshore sites for decades. In addition to the surface tow method mentioned above, the tow of such bodies has been carried out on bottom, elevated off bottom or at mid depth where the negatively buoyant body was suspended and tensioned by two tow vessels. Also these methods are associated with disadvantages. The former two can be used in special cases only when depth, bottom conditions and integration into a seabed system allow. The latter is characterized by demanding control, large loads involved and lack of facility to bring the body to surface in case of contingency or for planned operations such as connection with other sections or preparation for installation.

THE INVENTION

In accordance with the present invention the tendon is designed and made, in traditional fashion, of hollow cylindrical sections such as pipes that are connected into a continuous string. However, the interior of the string is divided into one or several compartments. The optimum number of compartments depends on water depth at installation area, typically 6 to 10. Before installation of the tendon each of the compartments is pressurized by gas, e.g. nitrogen or dried air, to a pressure that is close or equal to ambient water pressure at the depth where the compartment will be found after completed installation. Hence, the undesirable external stresses generating buckling loads are eliminated or significantly reduced during the time when the tendon is in use. This opens for the possibility to increase diameter, thus increase the inherent buoyancy of the tendon without the need of larger wall thickness, as it would be required if the traditional design would be applied. Therefore, the designer can optimize the diameter in order build-in desirable buoyancy for transport, installation, operation and finally removal. At the same time pipes of standard dimensions can be used and material saving is achieved, typically 30% weight reduction compared to standard design of tendons for a deepwater platform (i.e. platform at more than 3.000 ft water depth).

The tendon can be designed with uniform diameter over its entire length in order to eliminate locations exposed to fatigue stresses. In such a case the tendon upon completion of pressurization would have stepwise increasing net buoyancy when floating in surface because of decreasing weight of pressurized gas in the compartments, the bottom compartments being the heaviest thus least buoyant. Since the transport and installation method requires uniformly distributed net buoyancy the excessive buoyancy is counterweighted by ballast added.

The tendon can also be designed with stepped diameter so that the above-explained need for ballast is eliminated. In such a case attention is paid to design of details of the transitions so that the fatigue loads are eliminated or significantly reduced.

Some of the lower compartments can be flooded after installation connection to the platform. The weigth of flooded water represents reduction of upward tension loads (typically several hundred tons) on the anchor, and thus reduces the required size/weigth of the anchor.

Identically with the state of the art installation technology also here the tendons are towed in horizontal position and at the installation site upended and connected to pre-installed anchor. The present inventive tow method is of general applicability and overcomes all major disadvantages of the existing methods briefly described above without introducing shortcomings of significance for time, costs or safety. The present method is characterized as follows:

At initiation and termination of the tow or in contingent situation the towed slender body such as a flowline bundle, a pipeline section or a TLP tendon attains a safe and comfortable position floating in the surface.

During tow the slender body is submerged to desirable depth to avoid fatigue loads from waves.

Physical laws prevent, for all practical applications, possibility that the body towed in submerged position would collide with seabed in unpredicted or unexpected shallow water.

The inventive installation method for tendons and similar structures is integrated with the present tow method in the sense that the tow vessels perform the upending and rough positioning as a natural continuation of the tow and without need for re-rigging or other interventions. When upended and positioned to target area close to the pre-installed anchor, the tendon is pulled to vertical or side entry bottom connector on the anchor by means of moderate forces generated in simple rigging.

Another advantageous feature achieved by the invention is simple removal of the tendon, intact or with one accidentally flooded compartment. The inventive removal method for tendons is facilitated by the inherent properties of the tendon in accordance with the invention, namely:

The compartmentation of the interior and pressurization of gas inside the compartments limit the amount of water that can leak into the interior.

The pressurized gas inside the compartments enables to displace all or parts of the flooded water hence to ensure, in most practical instances, that the tendon can regain positive buoyancy that simplifies the retrieval and tow of the tendon.

From the design of the tendon point of view the most important advantage achieved is reduced consumption of material hence lower price. This aggregated advantage is a result of the following:

Reduced or eliminated loading from ambient water pressure.

Facilitated use of pipe sections of standard dimensions and materials.

Further, the design allows for greater water depth in which metallic tendons can effectively be used. Moreover, the inherent buoyancy of the tendon lessens the size of temporary buoyancy tanks required to keep tension in the tendon before installation of the platform is completed and tension can be generated by the platform itself. Finally, the design allows for flooding of dedicated compartments after installation of the platform with the aim of reducing loads on the anchors.

From the transport of the tendon or any other similar object point of view the most important advantages achieved are as follows:

Increased safety due to inherent fail-to-safe ability in the sense that in case of failure the object floats up to a stable position in surface and the object is prevented from collision with seabed in case of unidentified shallows.

Reduced fatigue loading due to the fact that the object is transported submerged below wave zone.

Eliminated possibility of unintentional collision with seabed during tow.

Reduced transport cost resulting from eliminated or reduced need for temporary buoyancy elements or floats that are commonly used for achieving desired buoyancy for transport.

From the installation of the tendon point of view, i.e. upending, positioning and connecting, the most important advantages are reduced price due to simple installation gear and applicability of inexpensive vessels, reversibility and easy control of all operations.

From the removal/replacement point of view the most important advantages is the simplicity of transferring the negatively buoyant tendon from its vertical position to horizontal position in which it is floating in surface, i.e. positively buoyant and ready for tow to the receipt destination. This simplicity is achieved in most of the expected instances when removal of the tendon is required.

DESCRIPTION OF EMBODIMENTS

Figure 1:
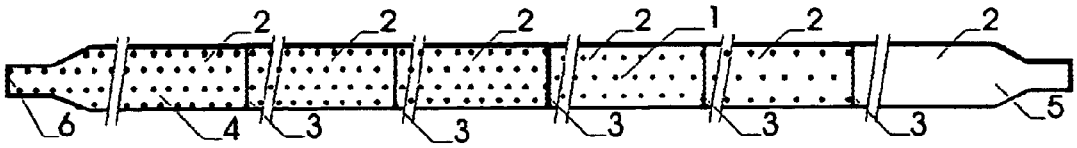
FIG. 1 shows a schematic drawing of a tendon.

FIG. 1 shows schematics of a tendon 1 with uniform diameter that is divided by inner bulkheads 3 into compartments 2. The compartments 2 are pressurized by gas to nearly ambient pressure at the operation depth where the lower compartment 4 has the largest pressure and the upper compartment 5 has the lowest pressure, often equal to atmospheric pressure. Shading of different density indicates the pressure level in the individual compartments 2, 4 and 5. Each of the inner bulkheads 3, is outfitted for pressurization by gas or for both pressurization by liquid (for pressure testing) and for final pressurization by gas. In the former case the outfitting includes a valve and a backup valve on a pipe through the bulkhead as shown in FIG. 24.

Figure 24:
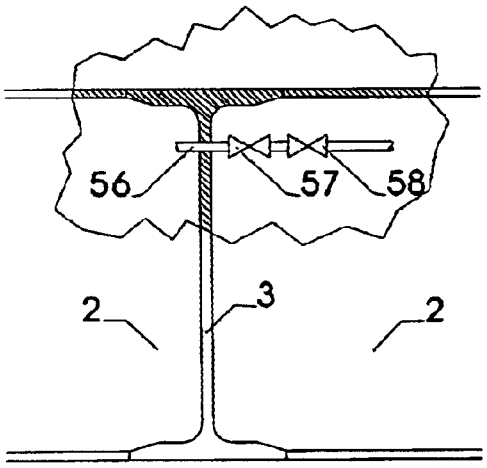
FIG. 24 shows an alternative arrangement of bulkheads with outfitting for final pressurization.

FIG. 24 shows an arrangement of a bulkhead 3 separating adjacent compartments 2 and with outfitting for final pressurization consisting of a pipe 56 with valves 57 and 58 (one of these as backup). Upon completion of pressurization the valves 57 and 59 are remotely triggered to close hence separate the two adjacent compartments.

The valves 57, 58 are open at the beginning of pressurization, thus the injected gas through the lower end bulkhead 3 can fill the all compartments 2, 4, 5. When the pressure inside has reached the required pressure in the upper compartment, the valves 57, 58 belonging to this compartment are shut (by remote control) thus no more gas can flow into this compartment. Upon reaching second pressure level the next compartment 2 is closed and so on until entire pressurization scheme has been completed. In case that the upper compartment 5 remains non-pressurized due to small ambient pressure, the associated inner bulkhead 3 is without any passthrough and valves.

Since there is a significant pressure difference between the lower and upper compartments, different weight of gas is contained in the compartments 2, 4, 5. In order to compensate for lower weight in all other compartments but the lower one or two, it is necessary to add ballast in order to obtain evenly distributed net buoyancy along the tendon 1 that is required for tow and upending. As the ballast is not needed in the operational phase, the ballast can be temporary. However, the ballast affects the performance of the tendon 1 in operational phase so insignificantly that it can also be permanent. Therefore the practicalities are decisive for using permanent or temporary ballast. The use of permanent ballast can be considered advantageous in the case when simple removal of the tendon 1 is a design consideration. In such a case the tendon 1 is at any time ready for removal.

Figure 2:
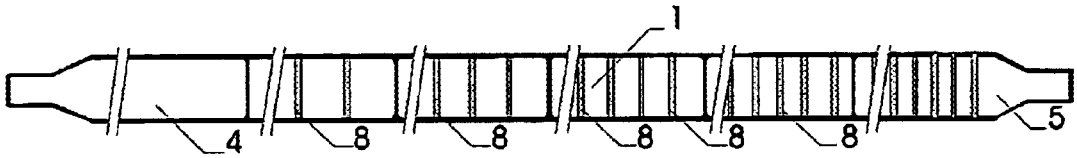
FIG. 2 shows a longitudinal section view of the tendon in FIG. 1 provided with ballast.

FIG. 2 shows section trough tendon 1 provided with permanent ballast in form of ballast elements 8 fixed in the interior of the tendon 1. The ballast elements 8 can be of different design, materials and size as long as these will not affect performance of the tendon. An innovative solution is the use of discarded car tires that can be pulled inside, individually or bundled, so that they expand against the walls and produce sufficient friction to hold their own weight.

Figure 26:
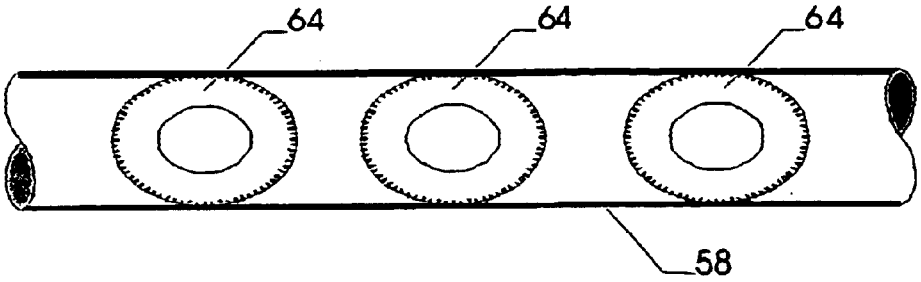

FIG. 26 shows another example of solid inner ballast where in a section 58 of a tendon compartment the solid ballast is made of used tires 64. As the dimension of the tires are larger than inner diameter of the tendon, these are deformed when deployed thus producing contact loads with the tendon and hence friction keeping the tires in position. In order to achieve more weight and or larger dimensions or larger contact loads two or more tires can be bundled together.

Figure 25:
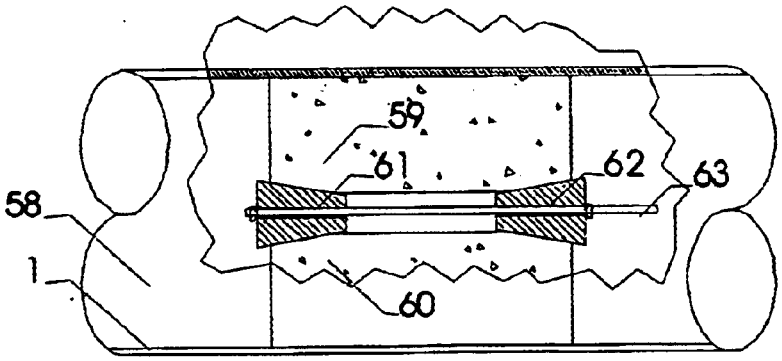
FIGS. 25 and 26 show alternative arrangements for permanent solid ballast in the interior of the tendon.

FIG. 25 shows an example of solid inner ballast where in a section 58 of a tendon compartment the solid ballast is made of weight elements 59 and 60 that are forced towards the tendon wall 1 by wedges 61 and 62 to create friction that is sufficient to keep the arrangement in place. Bolt 63 is used to produce the required compression between the wedges and the wall.

Temporary ballast can be fixed to the tendon from outside. A typical solution of this type is the use of one or more chains running along the tendon and fixed to the exterior at convenient intervals. Temporary ballast in the interior can be a fluid contained in inner pipes of appropriate diameter. In such a case the temporary ballast is displaced by gas when required (see FIG. 27).

Figure 27:
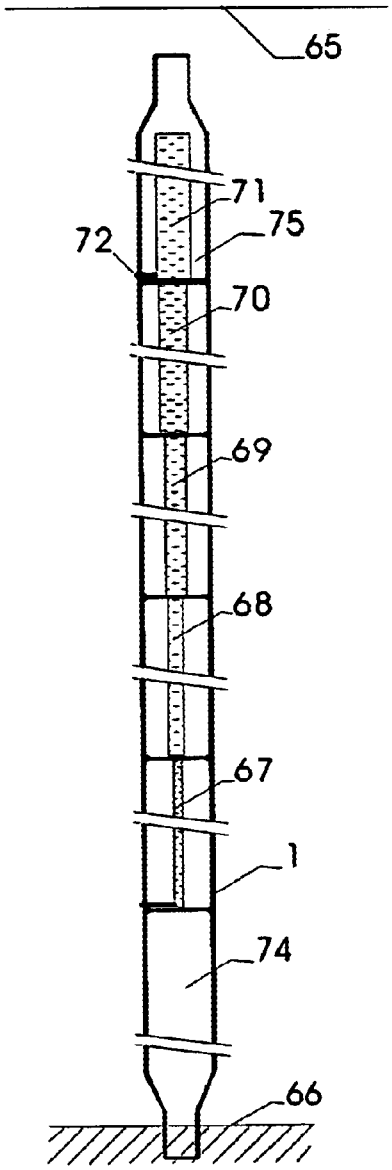
FIG. 27 shows a principle for temporary ballast where the ballast is water.

FIG. 27 shows a tendon 1 with temporary liquid ballast installed below water surface 65 in vertical position and connected to a seabed anchor 66. The ballast liquid is contained in pipes 67 to 71 of diameter increasing from the second lowest compartment 74 to the uppermost compartment 75 so that the increasing weight of water compensates for lower weight of pressurized gas.

Figure 28:
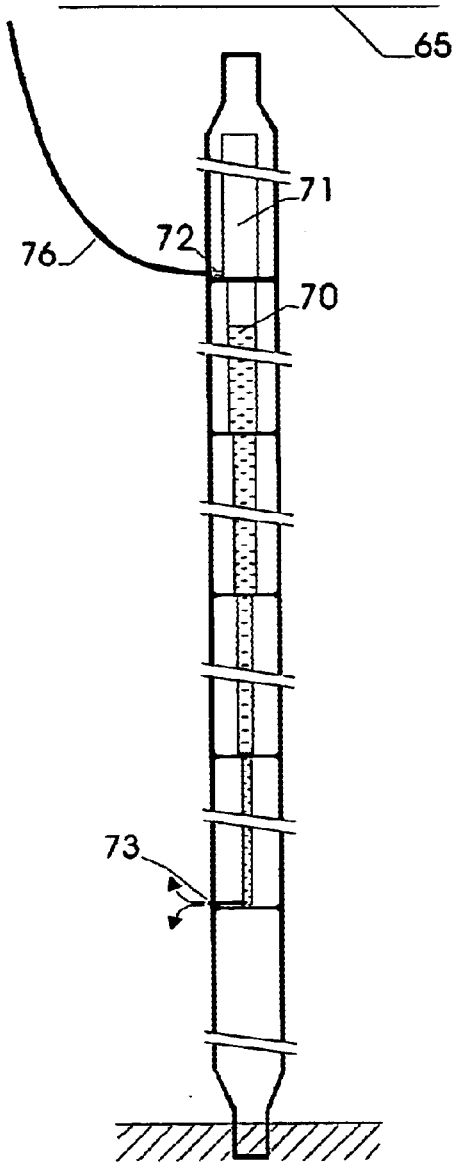
FIG. 28 shows the tendon being deballasted by supply of air.

FIG. 28 shows the tendon 1 being deballasted in order to achieve sufficient buoyancy 35 required for the time period before the tendon is connected to the platform. Often the deballasting can eliminate the use of the temporary buoyancy tank shown in FIGS. 4 and 5. The deballasting is achieved by supply of air through a hose 76 and inlet 72 into the ballast pipe 71 in the upper compartment 75. The air displaces water from the ballast pipe through an outlet 73 in the second lowest compartment 74. If required, e.g. for removal of the tendon, the tendon can be ballasted by venting of the air.

Figure 3:
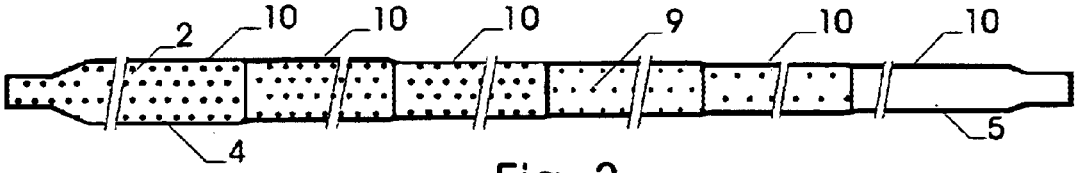
FIG. 3 shows a tendon with stepped diameter.

FIG. 3 shows a tendon 9 with stepped diameter. In this arrangement each section 1 compartment 4, 10, 5 starting from the lower compartment 4 has outer diameter sized down so that the buoyancy reduction due smaller diameter is equal to the reduced weight of the pressured gas. In this manner the net buoyancy is constant along the entire tendon 9 and no ballast is required. Wall thickness of the pipe sections 10 is chosen so that the material cross section area is approximately equal for any part of the tendon 9.

Figure 4:
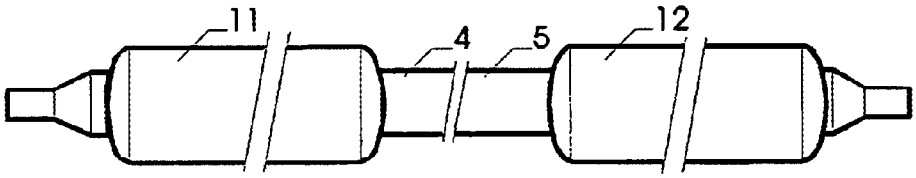
FIG. 4 shows the lower end compartments and the upper end compartment of the tendons in the previous figures.

FIG. 4 shows the lower end compartment 4 provided with temporary lower buoyancy tank 11 and upper end compartment 5 provided with temporary upper buoyancy tank 12. These tanks 11, 12 add buoyancy to the heavy end connectors (indicated in the figure by the narrowed pipe sections) that are normally not self-buoyant. The upper buoyancy tank 12 may also have an additional buoyancy, counterweighted by ballast water during tow and installation, that is needed to tension the tendon in the intermediate phase between completed installation of the tendon and hook-up of the tendon to the platform. The additional buoyancy is recovered at appropriate time by displacing ballast water out of the tank 12 by gas. In order to achieve exact buoyancy for tow and installation, it is advantageous to divide the interior of the tank 12 into two compartments: (a) For buoyancy during tow; this compartment is closed which means that it must be designed for the actual pressure differential. (b) For buoyancy required for tensioning the tendon upon installation; this compartment may be open to the sea hence not necessary to design for resisting significant pressure differentials.

Figure 5:
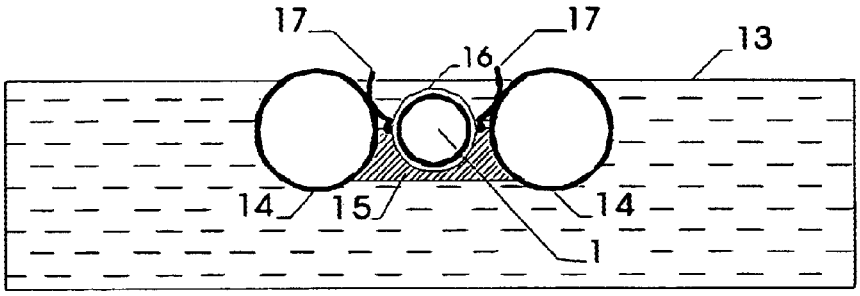
FIG. 5 shows a cross-section through tendon or other slender body and a front-view of an advantageous arrangement of the buoyancy tank that is partly fixed to the tendon.

FIG. 5 shows a cross-section through tendon 1 or other slender body and a front-view of an advantageous arrangement a buoyancy tank that is partly fixed to the tendon. Water surface 13 indicates position of the assembly when floating in surface during final fixing of the tank and during tow. In this arrangement the tank consists of two cylindrical elements 14 that are rigidly connected by means of a support structure 15 into a single body. The support structure 15 fits an 'outer bulkhead' or flange 16 on the tendon 1 that is designed to transfer all longitudinal loads from the tank to the tendon 1 or other slender body. For easy installation and retrieval of the tank 14 the connection to the tendon 1 can be made by means of clamps 17 that can comfortably be engaged/disengaged both in surface and subsea.

Figure 6:
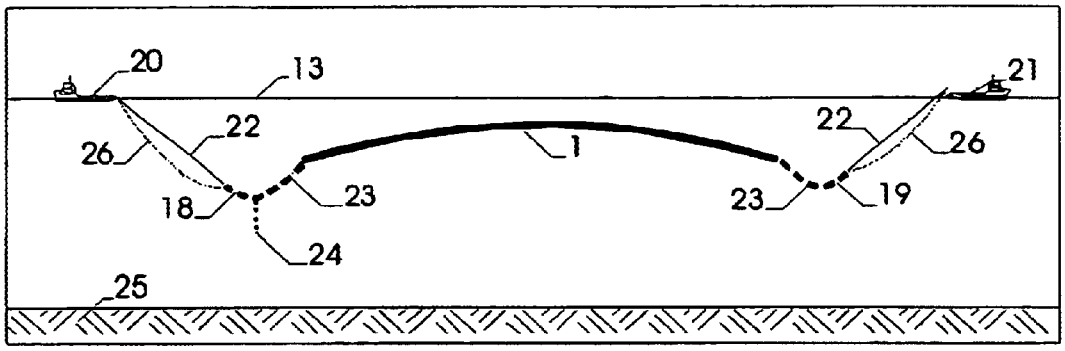
FIG. 6 shows the configuration for tow of a slender body such as pipeline, flowline bundle or TLP tendon in open sea.

FIG. 6 shows the configuration for tow of a slender body such as pipeline, flowline bundle or TLP tendon 1 in open sea according to the present invention. The tendon 1 or other slender body is submerged below water surface 13 and wave zone hence protected from waves and fatigue stresses and in emergency situations from collisions with crossing vessels.

The net buoyancy of the tendon 1 or other slender body is overcome by weight of towing gear 18 and weight of trailing gear 19. In sum the towing and trailing gear 18, 19 are heavier than the total net buoyancy of the tendon 1 so that when lowered into water they pull the tendon 1 below water and the tendon assumes a shape resembling an upended catenary. The system is by physical laws at any time in equilibrium and the excessive weight of the towing gear is transferred onto the towline. In order to prevent overstressing, it may be necessary to generate tension in the tendon 1 or other slender body when the gear 18, 19 are applied for submerging the tendon 1. The tension is generated by the leading tug 20 and by the trailing tug 21. The towing and trailing gears 18 and 19 are each composed of towing wire 22 and a heavy section 23 made of e.g. chain. For installation purposes it may be advantageous to add a clump weight 24 to the towing gear 18 that is connected to the lower end of the tendon 1. The submergence depth of tendon 1 or other slender body is controlled by length of the towline 22 that is paid out and the tension generated by the vessels 20 and 21. The design of the tendon 1 or other slender body seeks to keep the required tension at a practical limit of say 30 t. Should the bottom of the towing gear 18 or the clump weight 24 unintentionally come in contact with seabed 25, the load onto the tendon 1 or other slender body would be reduced and the tendon 1 would assume a position higher in the water. It is impossible for the tendon 1 or other slender body to collide with the seabed, unless very uneven topography of seabed is encountered where height of outcrops exceeds to combined height of catenaries of the tow gear 18 and the tendon 1. In case of contingent situation that could lead to loss of required minimal tension in the slender body, such as due to machine blackout or towline failure, auxiliary towline 26 operated by an independently driven winch (not shown) is activated to retrieve the towing and trailing gears 18, 19 and or to resume the towing force.

Figure 7:
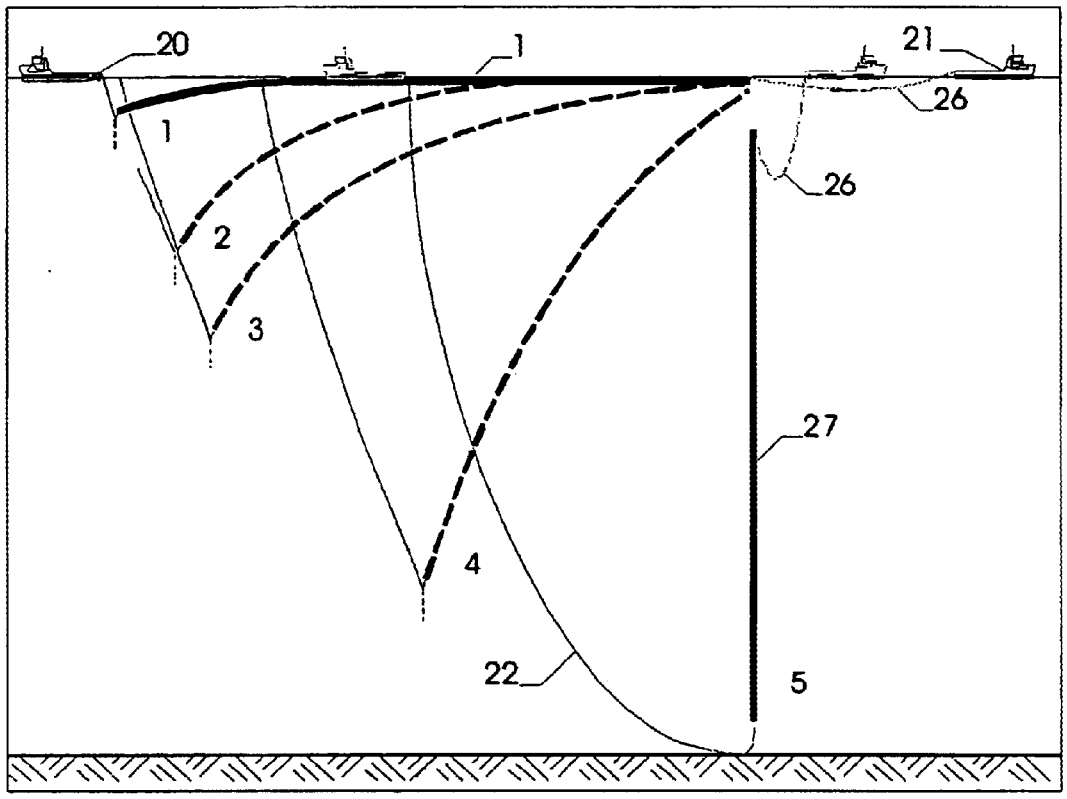
FIG. 7 shows five phases in upending of a tendon.

FIG. 7 shows five phases in upending of a tendon 1 according to the present invention see also FIG. 6. Phase 1: Upon arrival to the upending site the trailing gear 19 is retrieved to deck of trailing vessel 21. This leads to the tendon ascending to surface. The auxiliary towline 26 is reconnected to top of the tendon 1 in order to transmit tension into the tendon 1 during upending. Phases 2, 3 and 4: Leading tug 20 pays out towline that lowers the leading end of the tendon towards seabed. Leading tug 20 and trailing tug 21 keep the required tension in the tendon 1 that decreases with increasing depth to the lowered end of the tendon. Phase 5: The upended tendon 1 is in stable position above seabed where the net buoyancy is balanced by corresponding length and weight of towing gear 18 that is lifted off bottom. The remaining part of the towing gear is resting on the seabed 25 thus providing the tendon 1 with stability against horizontal loads.

Figure 8:
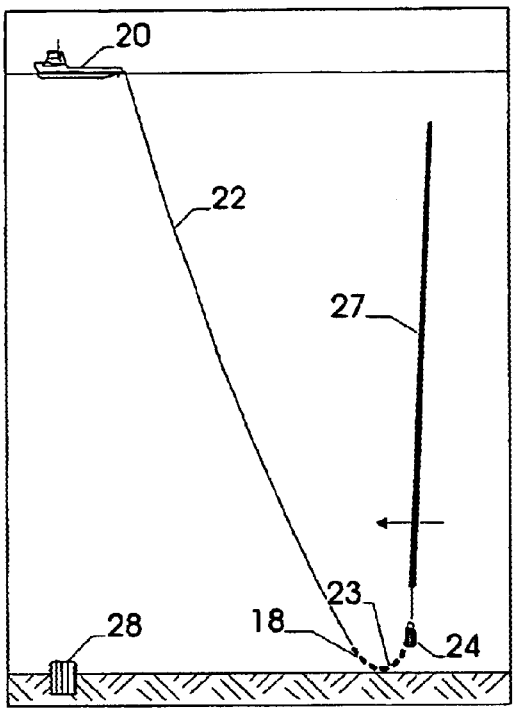
FIGS. 8–11 show various phases during positioning and connection of a tendon to a preinstalled anchor.

FIGS. 8, 9, 10 and 11 show positioning and connection of a tendon 1 to a pre-installed anchor 28. FIG. 8 shows an upended tendon 1 being hauled from upending location to a target area near the anchor 28 or connection point. This is accomplished by the leading tug 20 that via towline 22 and section 23 on the tendon 1. The tension in towline 22 has a vertical component that lifts a part of the heavy section 23 off bottom 25 and enables an easy dragging of the assembly along seabed 25 towards the target area.

Figure 9:
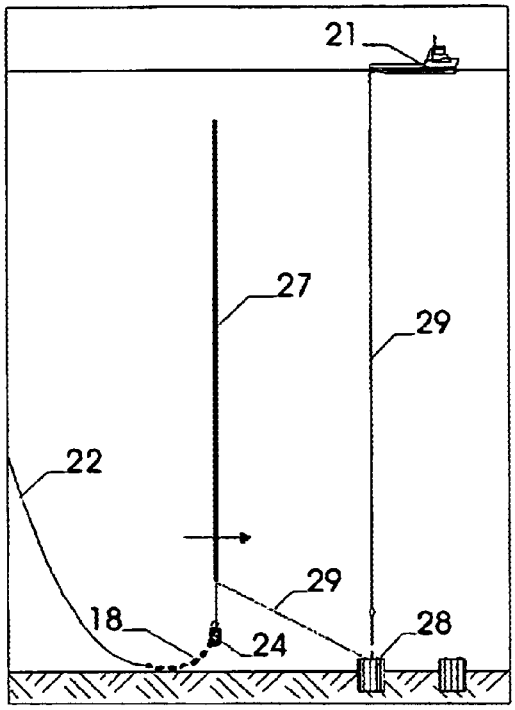

Next phase of the process of positioning and connecting is shown in FIG. 9 where the tendon 1 has been moved into the target area where a pre-rigged pull-in line 29 on the anchor 28 is connected to the tendon 1. In this particular version of several optional manners to achieve the positioning and connecting the trailing tug 21 lowers a tugger line 27 that connects to the pull-in line 29 and carries out the pull.

Figure 10:
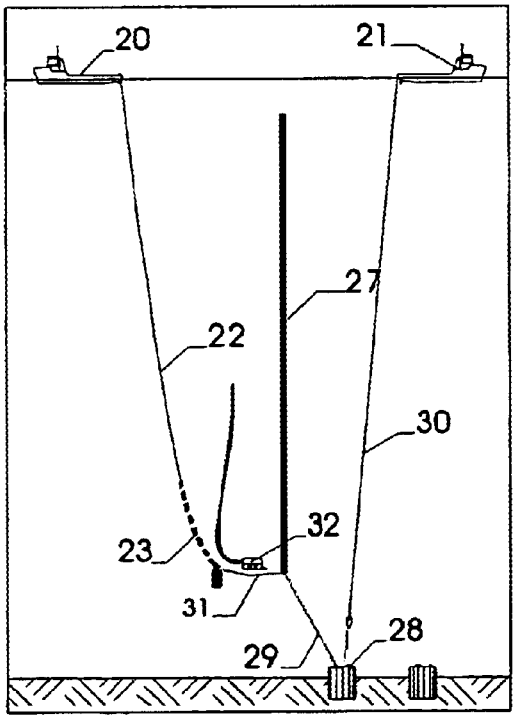

Next phase of the process of positioning and connecting is shown in FIG. 10 where the heavy section 23 has been lifted off the seabed 25 and tension in a connecting forerunner 31 is reduced to a minimum. This enables a remotely operated vehicle 32 to disconnect the tow gear heavy section 23 from the tendon 1.

Figure 11:
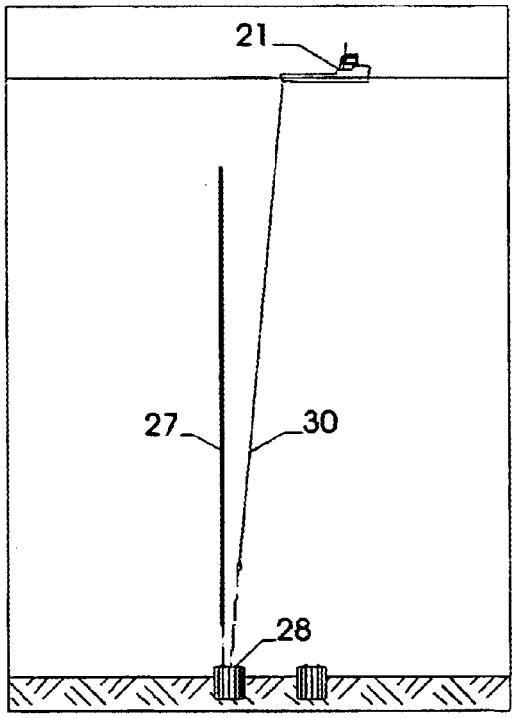

Last phase of the process of positioning and connecting is shown in FIG. 11 where the tendon 1 is being pulled from the vessel 21 via the tugger line 27 towards the bottom connector on the anchor 28.

Figure 12:
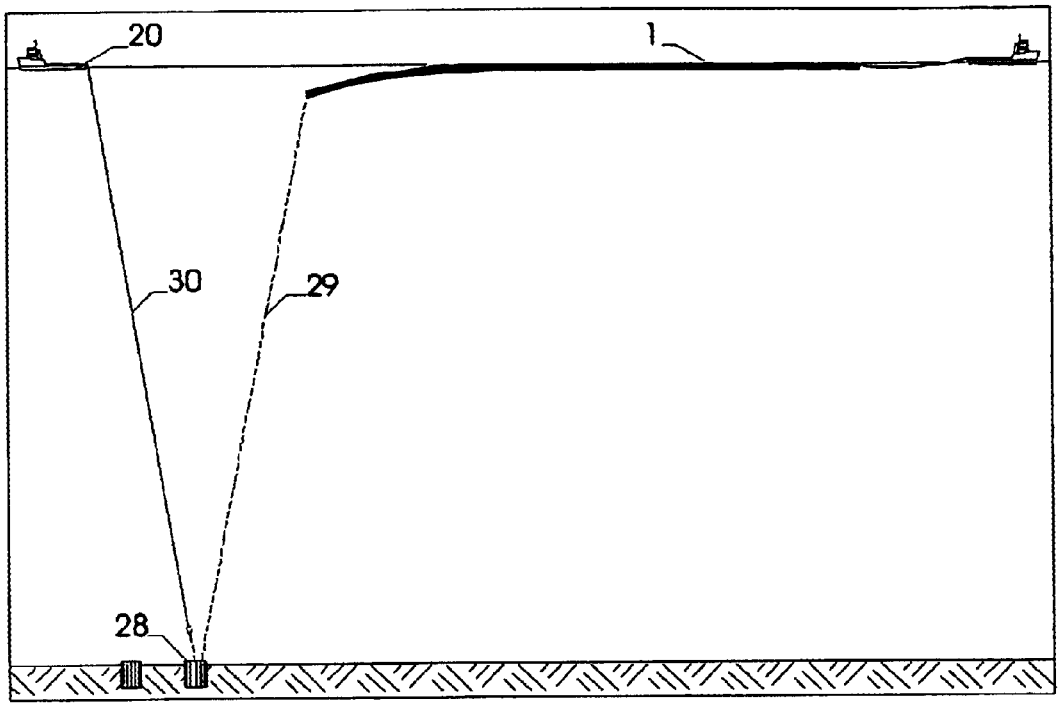
FIGS. 12–14 show another installation method.
Figure 13:
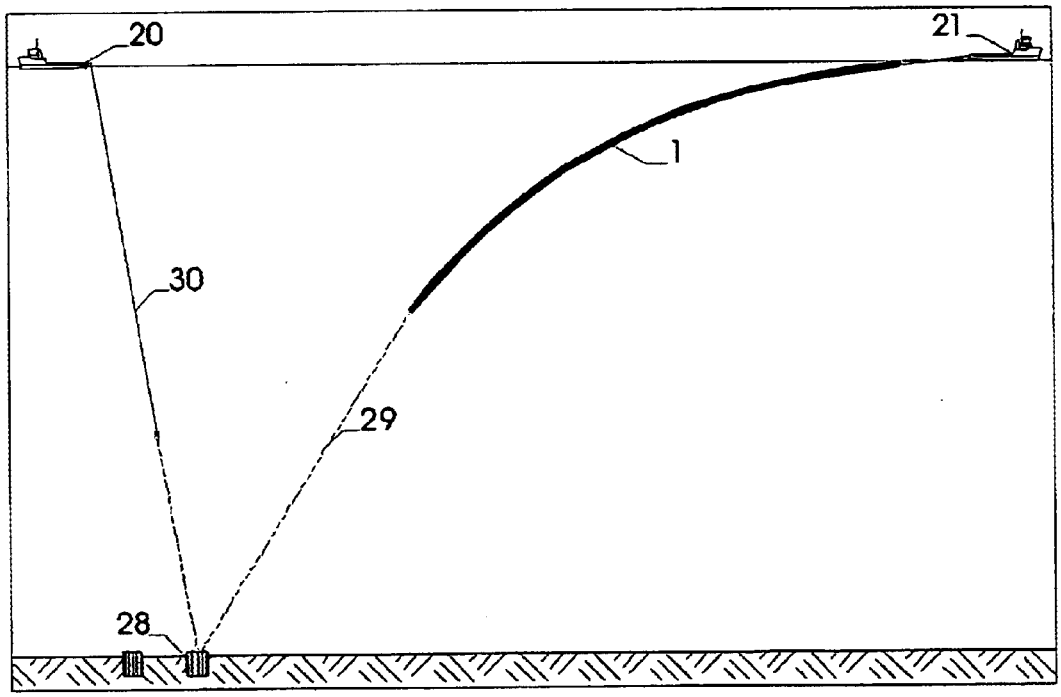
Figure 14:
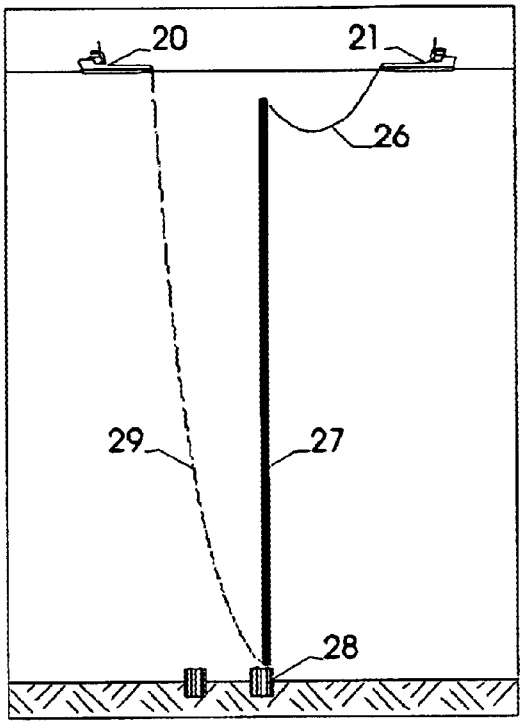

Another possible installation method is illustrated in FIGS. 12, 13 and 14. This installation method allows a direct pull of the tendon from horizontally floating in surface to the bottom connection in one operation.

FIG. 12 shows the initial position of tendon 1 with installed rigging for the operation. Upon arrival at the installation site the towing gears have been retrieved, pre-installed pull-in line 33 retrieved to surface and connected to lower end of tendon 1, tugger line 30 from vessel 20 lowered down to anchor 28 and connected to end of the pull-in line 33 and finally the vessel 20 has tensioned the lines 33 and 30.

FIG. 13 shows next phase of the installation where vessel 21 has tensioned the tendon as required to avoid overstressing and vessel 20 is in progress of reeling the tugger line 30 thus pulling the tendon 1 towards the connector on the anchor 28.

FIG. 14 shows the an upended tendon 1 connected to anchor 28, unloaded pull-in line 33 that is just before retrieval and unloaded auxiliary towline 26 just before retrieval to vessel 21.

The tow and installation methods enable to tow and installed more than one tendon in the same sequence of operations. Method and steps for tow, upending positioning and connecting of the first tendon in an approach involving multiple tendons are identical with those described above. Remain steps associated with positioning and connecting second tendon are explained in FIGS. 15 through 18.

Figure 15:
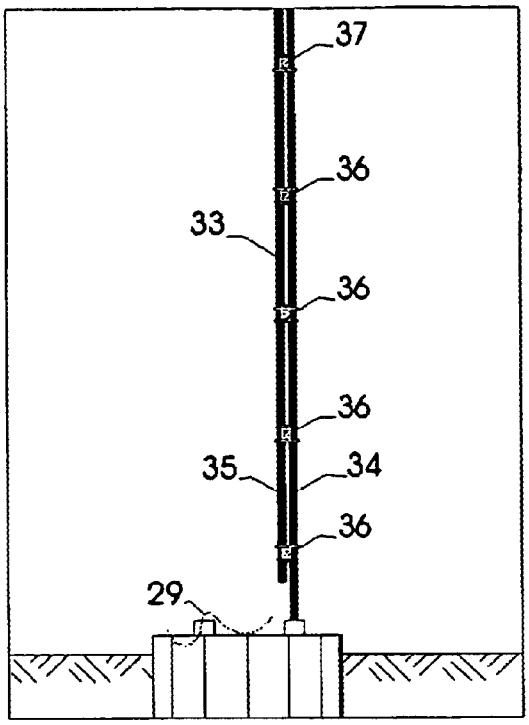
FIGS. 15–18 show steps associated with positioning and connecting a second tendon.

FIG. 15 shows bundle of tendons 34, 35 where tendon 34 has been connected to anchor 28. It is seen that lower end of second tendon 35 in the bundle is staggered so that its lower end does not prevent connecting of the first tendon 34. Tendons 34 and 35 are connected into the bundle in the lower part by spacers 36. Spacers 37 connect remaining part on the bundle. Finally, a pull-in line 29 is pre-installed.

Figure 16:
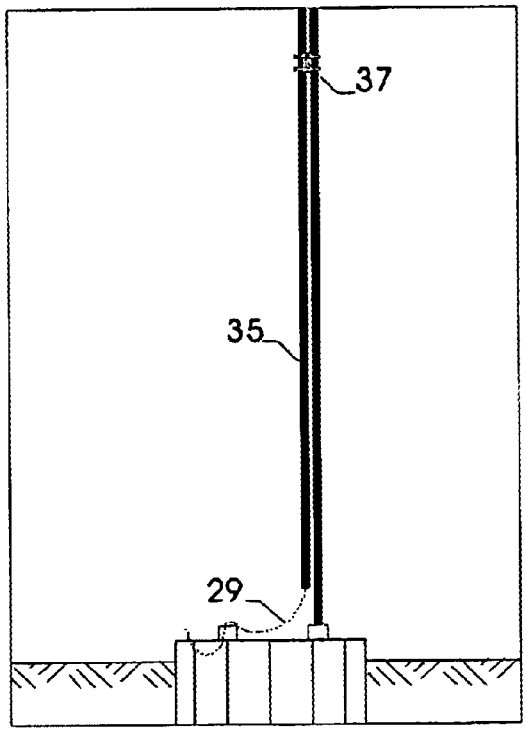

FIG. 16 shows the situation when the lower spacers, in FIG. 16 denoted 36, have been removed, e.g. by a remotely operated vehicle (not shown), and the pull-in line 29 connected to the second tendon 35.

Figure 17:
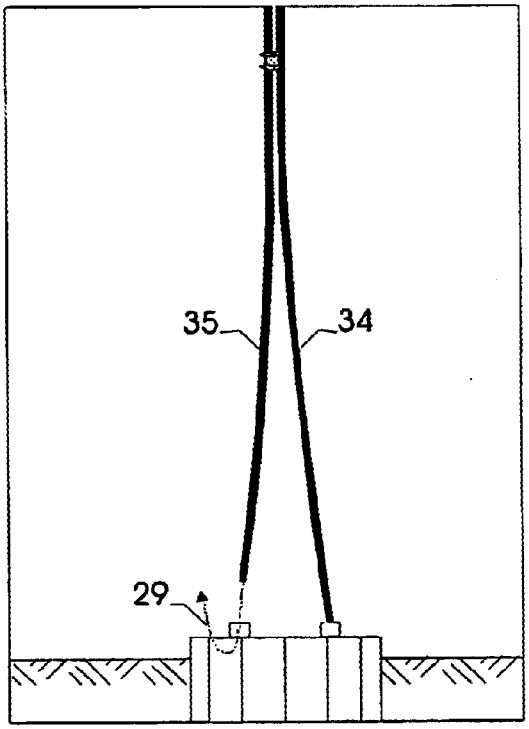

FIG. 17 shows that tension in pull-in line 29 is applied and tendon 35, in the lower section of the bundle, is parted from the first tendon 34 and that both tendons are gently bent (exaggerated in the figure).

Figure 18:
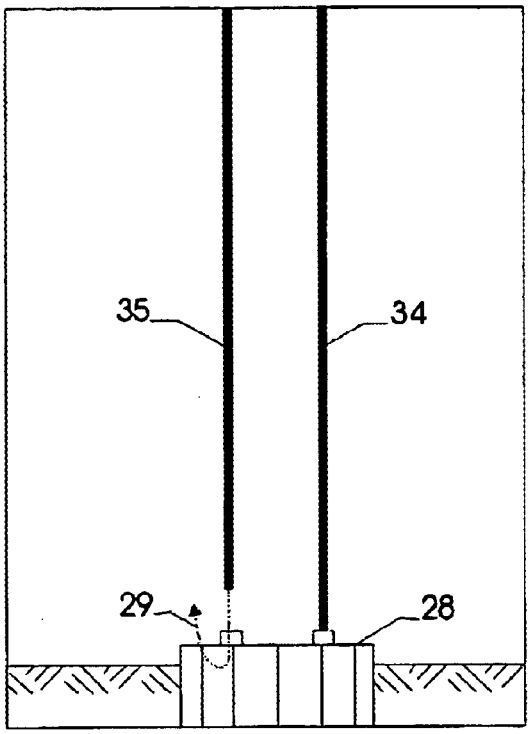

FIG. 18 shows situation when the remaining spacers (denoted 37 in FIG. 17) have been removed and the second tendon 35 is ready for pull down and making connection with the anchor.

Figure 19:
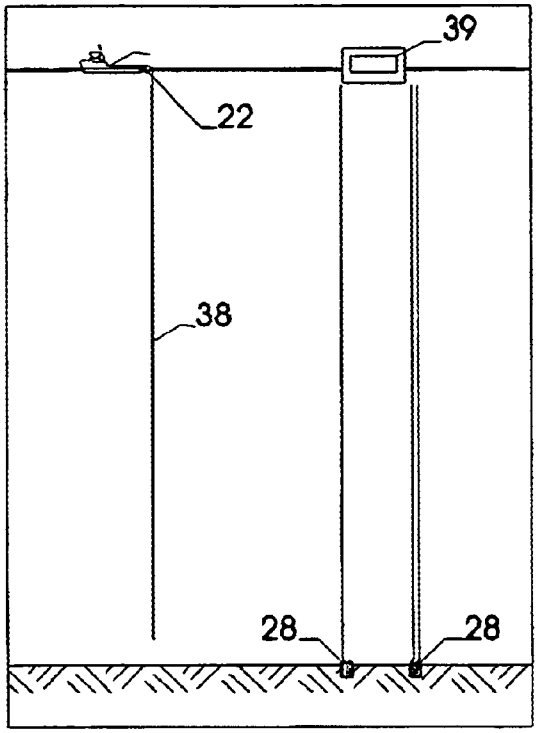
FIGS. 19 and 20 show removal/retrieval of a tendon from an installed position.
Figure 20:
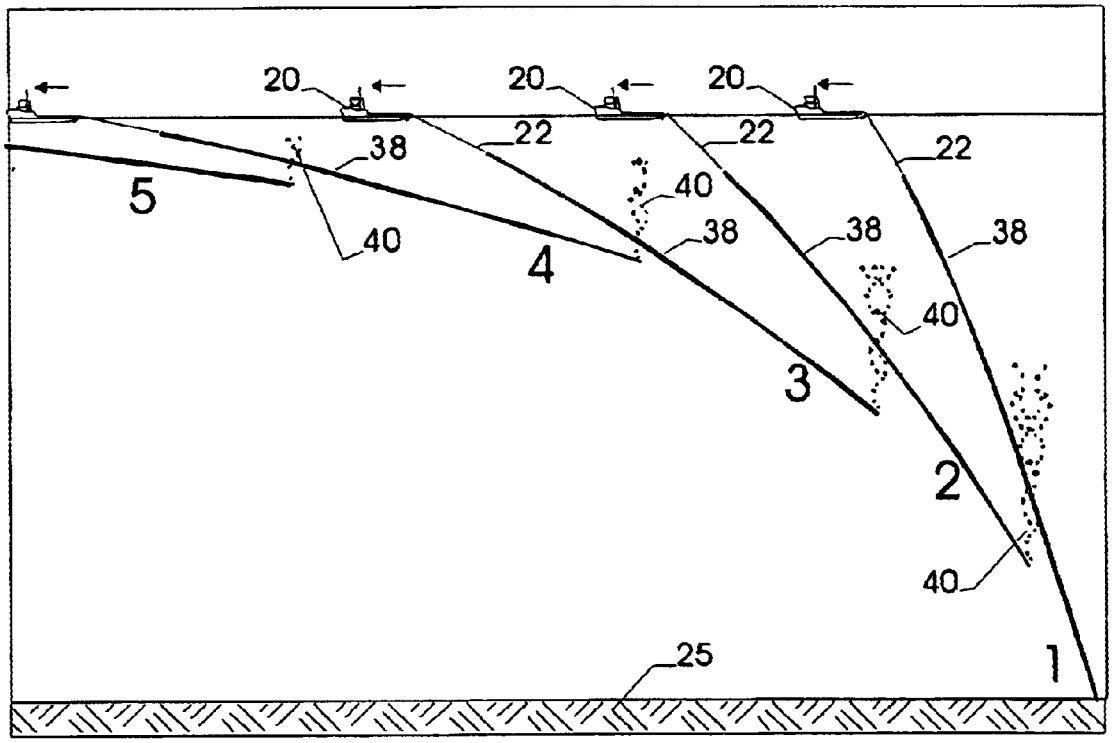

FIGS. 19 and 20 show removal/retrieval of a tendon 38 from installed position, in other words they show how the tendon is transferred from vertical position in which it is negatively buoyant and suspended from a vessel to a position suitable for tow to shore or elsewhere. The method shown in these figures is applicable for intact tendons and for accidentally flooded tendons where one compartment is flooded and a volume of gas is remaining in said compartment. The volume of remaining gas must be sufficient to displace so much of the flooded water so that the tendon can become positively buoyant. In seldom occasions when excessive volume of pressurized gas has escaped or when several compartments have been flooded the method for retrieval must be engineered for each case separately and upon the extent and location of the flooding have been identified. In such seldom occasions the retrieval method is a combination of the method illustrated in FIGS. 19 and 20 with conventional methods and the operation will resemble salvage.

FIG. 19 shows the first stage of removal of tendon 38. Before reaching the position illustrated in the figure

- the tendon 38 has been disconnected from the platform 39,
- a towline 22 from vessel 20 has been connected to the upper end of the tendon 38
- a flooding/draining hole has been drilled at suitable elevation above inner bulkhead (cfr. FIG. 1) through the wall of a selected compartment so that the amount water that can flow into the compartment makes the tendon negatively buoyant and required submerged weight can be achieved,
- the tendon 38 has been flooded by predicted amount of water into the selected compartment so that a target negative buoyancy and vertical stability (i.e. the center of buoyancy is over the center of gravity) have been reached,
- the tendon 38 has been disconnected from the anchor 28 and moved slowly a distance from the anchor 28.

FIG. 20 shows several stages of the transfer from vertical to floating in surface. The transfer progresses in time and corresponding situations are shown in the figure from the right to the left and are denoted as 1 to 5. The individual situations are explained as follows:

Situation 1. The tendon 38 is being towed by the vessel 22 at a 'small' speed and the length of the towline 22 is increased. For the purpose of explanation by means of this illustration the increased length keeps the lower end of the tendon 38 at approximately the level/height above the seabed 25 it had in installed position and therefore the amount on flooded water has not been changed. This length control is however not a condition for successful operation. Due to hydrodynamic loads from the relative motion between water and tendon, the tendon 38 is inclined into an equilibrium position.

Situations 2, 3, 4, and 5. In these situations the towing velocity has been increased so that the lower end of the tendon 38 is over the level it was during the flooding. Thus an overpressure builds up in the compartment and the flooded water is being displaced from the compartment. As the weight of flooded water is being reduced, the tendon 38 moves up with an accelerating effect for the displacement of flooded water. Eventually, the tendon 38 becomes positively buoyant and floats in surface ready for completion of the retrieval operation in a conventional manner.

Under special conditions it may be advantageous to design and pre-fabricate the tendon in sections that are connected into a continuous string before tow to the installation site or before upending and installation. A such design allows for reduced length of fabrication facilities, increases maneuverability through narrows during tow through inshore waters, if relevant, or reduces requirements to the offshore tow if towed to installation site as individual sections for assembling at the offshore site. In particular, this design may be advantageous for spare or replacement tendons. In the former case the storage of prefabricated tendons in sections is less demanding and in the latter case the replacement tendon may be fabricated in short-length facilities, thus enabling fast mobilization of the fabrication facilities and fast fabrication. The design of each section of such tendon can be identical with that described above for the "one section" tendons.

Figure 21:
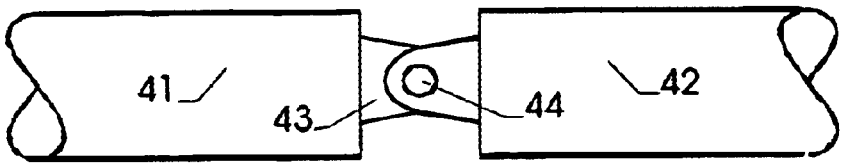
FIGS. 21 and 22 show a side view and a top view, respectively, of two connected tendon sections.
Figure 22:
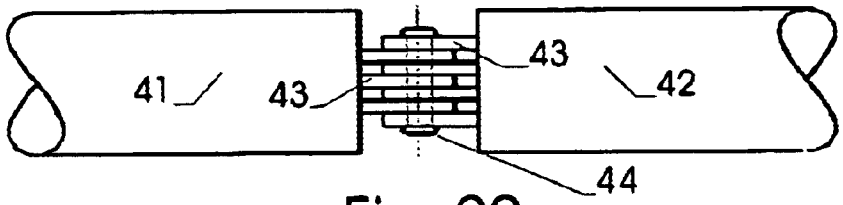

The connections between the sections may e.g. be as shown in FIGS. 21 and 22.

FIG. 21 shows a side view of a lower tendon section 41 connected to an upper tendon section 42 by means of a connector 43. From fabrication, assembly and operational points of view it is advantageous to design the connector 43 with freedom to move.

FIG. 22 shows a top view of the connector 43 where a bolt 44 connects the sections 41, 42 and allows rotation in one plane. As the tendon in operation always will be exposed to tension loads, there is no substantial wear in a such connection. Obviously the connector may be arranged with two mutually perpendicular rotational axes, allowing rotation in any plane, or a standard rigid connector that prevents all rotations.

Figure 23:
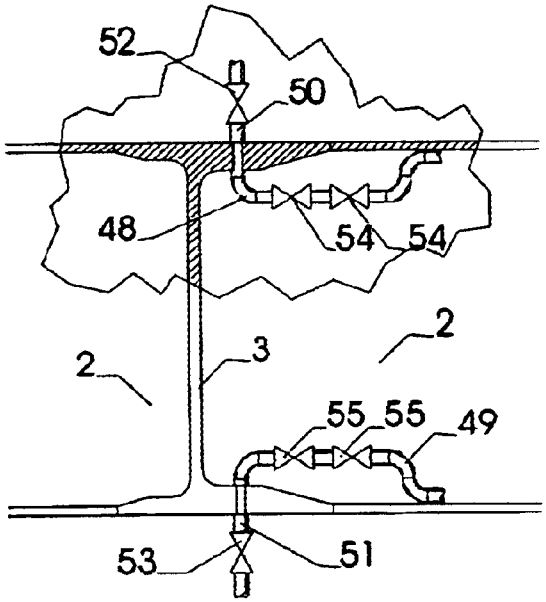
FIG. 23 shows an arrangement of bulkheads with outfitting for pressure testing and for final pressurization.

FIG. 23 shows an arrangement of bulkhead 45 separating adjacent compartments 2 with outfitting for pressure testing and for final pressurization consisting of parts 48 and 49. Part 48 serves for venting of gas of the upper compartment 2 during flooding of the compartment for testing, inlet of air during dewatering of the compartment upon completed test and for supply of gas for final pressurization. Part 49 serves as inlet for liquid to be used in a hydrostatic pressure test of a completed compartment and as outlet for draining the liquid upon completion of the pressure test. Parts 48 and 49 are provided with temporary inlets/outlets 50 and 51 that are removed upon completed pressurization. Outer valves 52 and 53 are used for closing the compartment during testing. Inner valves 54 and 55 are triggered to close upon the pressurization. These remotely operated valves are used only once, i.e. to close. After removal of the temporary parts 51 and 52 the inlets through the wall can be sealed thus achieving a third barrier against accidental leak.

What is claimed is:

1. A tendon for a tension leg platform to be erected in water comprising an outer cylindrical wall and two end bulkheads, one of the two end bulkheads positioned at each of the two ends of the tendon, said outer cylindrical wall and said two end bulkheads enclosing an interior space which is divided into compartments by interior bulkheads, each of the compartments being entirely empty, a preselected amount of pressurized gas sealed in each of the compartments before the tendon is placed in the water, said gas having a pressure corresponding approximately to the pressure of the water on the outer cylindrical wall of the tendon when the tendon is in the water in a vertical position.

2. The tendon according to claim 1, including ballast element(s), said ballast element(s) having a weight that evenly distributes net buoyancy along the tendon.

3. The tendon according to claim 2, wherein the outer diameter of each of the compartments are all equal.

4. The tendon according to claim 1, wherein each of the compartments have an outer wall with an outer diameter which is largest for the compartment intended to be closest to the bottom of the ocean when the tendon is in a vertical position, the compartment intended to be second closest to the bottom of the ocean has an outer diameter which is smaller than the previous compartment and so on, and wherein a material cross section area is approximately equal for any part of the tendon, and the ratios between the outer diameters are so that the net buoyancy is constant along the entire tendon.

5. A method for transporting a fluid containing tubular body or assembly of bodies having a longitudinal direction above a sea/river bed floor and within a body of water, said fluid having a density which is less than the density of water, said method comprising the steps of:

connecting a first end of a first towing gear to a first end of the tubular body;

connecting a second end of the first towing gear to a first tug device;

connecting a second end of the tubular body to a first end of a second towing gear;

connecting a second end of the second towing gear to a second tug device;

said first and second towing gears each comprising a towing wire and a heavy weight element in the water;

allowing the tug devices to tug the tubular body so that the tubular body is under tension in its longitudinal direction; and adjusting the submergence depth of the tubular body by controlling the length of the towing wire.

6. The method according to claim 5, wherein the weight of the towing gears is heavy enough to keep the tubular body floating submerged in the water.

7. The method according to claim 5, wherein the tubular body has a buoyancy and the weight of the towing gears is heavy enough to keep the tubular body floating in an upended catenary fashion in the water.

8. A method when installing an internal pressurized tendon in a vertical position in a body of water, comprising the steps of bringing the tendon having a leading end and a trailing end in a substantially horizontal floating position in the water between a leading and a trailing vessel, the vessels being connected to the leading and the trailing end, respectively, through a leading and a trailing towing gear comprising a towing wire and a heavy weight element in the water, respectively, dismissing the heavy weight element from the trailing towing gear, and allowing the leading tendon end to lower controlled in the water until the heavy weight element in the leading towing gear rests at least partly on a floor of said body of water.

9. A method when installing an internal pressurized tendon in a vertical position in a body of water and securing a lower end of the tendon to an anchor pre-installed on a floor of the body of water, comprising the steps of bringing the tendon having a leading end and a trailing end in a substantially floating position in the water between a leading and a trailing vessel, the vessels being connected to the leading and the trailing end, respectively, through a leading and a trailing towing gear comprising a towing wire and a heavy weight element in the water, respectively, dismissing the heavy weight element from the trailing towing gear, allowing the leading tendon end to lower controlled in the water until the heavy weight element in the leading towing gear rests at least partly on the said floor, securing an end of a pull-in line on the anchor to the leading tendon end and pulling said leading tendon end towards a bottom connection on the anchor.

10. A method when removing or retrieving a tendon from an installed position in a body of water, said tendon having an upper end installed to a platform and a lower end connected to an anchor, comprising the steps of disconnecting the tendon from the platform, connecting a towline from a vessel to the upper end of the tendon, allowing water to flood into the tendon thereby making the tendon negatively buoyant and vertically stabile, disconnecting the tendon from the anchor, towing the tendon with a towing velocity so that the lower end of the tendon ascends in the water, whereby flooded water is being displaced from the tendon and the tendon moves up in the water.

11. A tendon for a tension leg platform to be erected in water comprising an outer cylindrical wall and two end bulkheads, one of the two end bulkheads positioned at each of the two ends of the tendon, said outer cylindrical wall and said two end bulkheads enclosing an interior space which is divided into compartments by interior bulkheads, each of the compartments being entirely empty, a preselected amount of pressurized gas sealed in each of the compartments before the tendon is placed in the water, said gas having a pressure corresponding approximately to the pressure of the water on the outer cylindrical wall of the tendon when the tendon is in the water in a vertical position;

wherein each of the compartments have an outer wall with an outer diameter which is largest for the compartment intended to be closest to the bottom of the ocean when the tendon is in a vertical position, the compartment intended to be second closest to the bottom of the ocean has an outer diameter which is smaller than the previous compartment and so on, and wherein a material cross section area is approximately equal for any part of the tendon, and the ratios between the outer diameters are so that the net buoyancy is constant along the entire tendon.

* * * * *